US007690894B1

(12) United States Patent
Liang

(10) Patent No.: US 7,690,894 B1
(45) **Date of Patent: *Apr. 6, 2010**

(54) CERAMIC CORE ASSEMBLY FOR SERPENTINE FLOW CIRCUIT IN A TURBINE BLADE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 734 days.

This patent is subject to a terminal disclaimer.

(21) Appl. No.: 11/527,307

(22) Filed: Sep. 25, 2006

(51) Int. Cl.
*F01D 5/18* (2006.01)

(52) U.S. Cl. ..... 416/97 R; 415/115

(58) Field of Classification Search ..... 416/96 R, 416/97 R, 97 A; 415/115
See application file for complete search history.

(56) References Cited

U.S. PATENT DOCUMENTS

| | | | | | |
|---|---|---|---|---|---|
| 3,191,908 | A | * | 6/1965 | Petrie et al. | 416/96 R |
| 4,596,281 | A | | 6/1986 | Bishop | |
| 4,627,480 | A | | 12/1986 | Lee | |
| 5,050,665 | A | | 9/1991 | Judd | |
| 5,337,805 | A | | 8/1994 | Green et al. | |
| 5,394,932 | A | | 3/1995 | Carozza et al. | |
| 5,538,394 | A | * | 7/1996 | Inomata et al. | 416/97 R |
| 5,599,166 | A | | 2/1997 | Deptowicz et al. | |
| 5,813,835 | A | | 9/1998 | Corsmeier et al. | |
| 5,947,181 | A | | 9/1999 | Davis | |
| 6,036,441 | A | * | 3/2000 | Manning et al. | 416/97 R |
| 6,062,817 | A | | 5/2000 | Danowski et al. | |
| 6,079,946 | A | * | 6/2000 | Suenaga et al. | 416/97 R |
| 6,092,983 | A | | 7/2000 | Tomita et al. | |
| 6,340,047 | B1 | | 1/2002 | Frey | |
| 6,416,284 | B1 | * | 7/2002 | Demers et al. | 416/97 R |
| 6,464,462 | B2 | | 10/2002 | Stathopoulos et al. | |
| 6,547,525 | B2 | | 4/2003 | Haehnle et al. | |
| 6,637,500 | B2 | | 10/2003 | Shah et al. | |
| 6,761,535 | B1 | | 7/2004 | McGrath et al. | |
| 6,773,231 | B2 | | 8/2004 | Bunker et al. | |
| 6,966,756 | B2 | | 11/2005 | McGrath et al. | |
| 7,413,407 | B2 | * | 8/2008 | Liang | 416/97 R |
| 2004/0076519 | A1 | * | 4/2004 | Halfmann et al. | 416/97 R |
| 2007/0253815 | A1 | * | 11/2007 | Kopmels et al. | 416/97 R |

FOREIGN PATENT DOCUMENTS

EP 1094200 A1 * 4/2001

* cited by examiner

*Primary Examiner*—Edward Look
*Assistant Examiner*—Jesse Prager
(74) *Attorney, Agent, or Firm*—John Ryznic

(57) ABSTRACT

A turbine blade for use in a gas turbine engine having an internal serpentine flow cooling circuit with pin fins and trip strips to promote heat transfer for obtaining a thermally balanced blade sectional temperature distribution. The turbine blade is cooled by a 7-pass serpentine flow cooling circuit that extends from the leading edge and along the pressure side wall of the airfoil, into the trailing edge and then flows along the suction side wall ending just downstream from the leading edge where the 7-pass serpentine flow circuit started. Leading edge film cooling holes are supplied from the first leg of the serpentine while a row of trailing edge exit holes is supplied from the third leg which extends across both walls of the airfoil in the trailing edge.

10 Claims, 3 Drawing Sheets

CERAMIC CORE ASSEMBLY FOR SERPENTINE FLOW CIRCUIT IN A TURBINE BLADE

BACKGROUND OF THE INVENTION

1. Field of the Invention

The present invention relates generally to fluid reaction surfaces, and more specifically to air cooled turbine blades.

2. Description of the Related Art Including Information Disclosed Under 37 CFR 1.97 and 1.98

A gas turbine engine has a turbine section with a multiple stages of stationary vanes or nozzles and rotary blades or buckets exposed to extremely high temperature flow. The first stage vanes and blades are exposed to the highest temperature since the gas flow temperature progressively decreases through the turbine due to the extraction of energy. Especially in an industrial gas turbine engine, efficiency is the prime objective. In order to increase the efficiency of the engine, a higher gas flow temperature can be used in the turbine. However, the highest temperature that can be used depends upon the properties of the materials used in the turbine parts. For this reason, providing internal air cooling of the blades and vanes allows for a temperature higher than the material properties can withstand alone.

Another method of increasing the efficiency of the engine, for efficient use of the cooling air passing through the cooled airfoils is desired. Since the cooling air is generally bleed air from the compressor, maximizing the cooling effect while minimizing the amount of cooling air bled off from the compressor will increase the engine efficiency as well. Blade designers have proposed complex air cooling passages to maximize cooling efficiency while minimizing cooling volume. On a typical first stage turbine blade, the hottest surfaces occur at the airfoil leading edge, on the suction side immediately downstream from the leading edge, and on the pressure side of the airfoil at the trailing edge region. A showerhead arrangement is generally used to provide cooling for the leading edge of the airfoil. One problem blade designers are challenged with is that the hottest section on the suction side is also at a lower pressure than on the pressure side. A serpentine flow cooling circuit of the prior art that provides cooling for both the pressure side and the suction side will provide adequate cooling for the airfoil, but uses more cooling air that needed. Film cooling holes opening onto the pressure side and the suction side that are supplied with cooling air from the same cooling channel will both be discharging cooling air at the same pressure. Since the hot gas flow pressure on the suction side is lower than the pressure side, more cooling air will be discharged onto the suction side than is needed.

In a turbine airfoil with a serpentine flow cooling circuit, the cross sectional area of the passages must be sized in order than the airfoil walls will not be too thick. In many situations such as in open serpentine flow channels, some of the passages have cross sectional areas that are too large and result in low levels of heat transfer from the hot metal surface of the passage to the cooling air because the cooling air velocity is too low.

Turbine airfoils (which include blades and vanes) are typically cast as a single piece with the cooling passages cast within the airfoil. Ceramic cores having the cooling passage shape is used to form the airfoil.

It is an object of the present invention to provide a turbine airfoil with an internal cooling air circuit that would provide for a thermally balanced airfoil sectional temperature distribution.

It is another object of the present invention to provide for a turbine airfoil which allows for a maximize usage of the hot gas side pressure distribution in order to lower the required cooling air supply pressure to reduce the overall airfoil leakage flow.

It is another object of the present invention to provide for a ceramic core assembly with a minimum number of pieces while allowing for the above objectives to be met.

BRIEF SUMMARY OF THE INVENTION

A turbine airfoil such as a blade having a fully pin finned cooling mechanism incorporated into a counter flowing near wall serpentine flow cooling circuit of a seven-pass type. The first leg of the serpentine flow cooling circuit is located in the leading edge region and provides cooling for the region with the highest external heat load. Pin fins and trip strips are incorporated within the cooling supply cavity to enhance internal heat transfer performance. Cooling air is then serpentine rearward along the pressure side and into a trailing edge region where some of the cooling air is discharged through cooling exit holes in the trailing edge. From the third leg, the cooling air then advances into the fourth through seventh legs in a forward airfoil direction along the suction side of the airfoil. Film cooling holes in the fifth and seventh legs discharge some of the cooling air through film cooling holes onto the hottest sections of the suction side of the airfoil. Pin fins used in the suction side serpentine flow channels conduct heat from the airfoil wall into the inner partition wall. A two piece ceramic core is used to form the seven pass serpentine flow circuit, and includes a pressure side core having the first and second legs with a cooling air transport tongue extending from the second leg. A suction side core includes the third through seventh legs with a cooling air transport groove formed in the entrance to the third leg to accept the tongue on the pressure side core. The tongue and groove function to hold the two cores together and to form the cooling air passage from the second leg to the third leg.

DETAILED DESCRIPTION OF THE INVENTION

Figure 1:
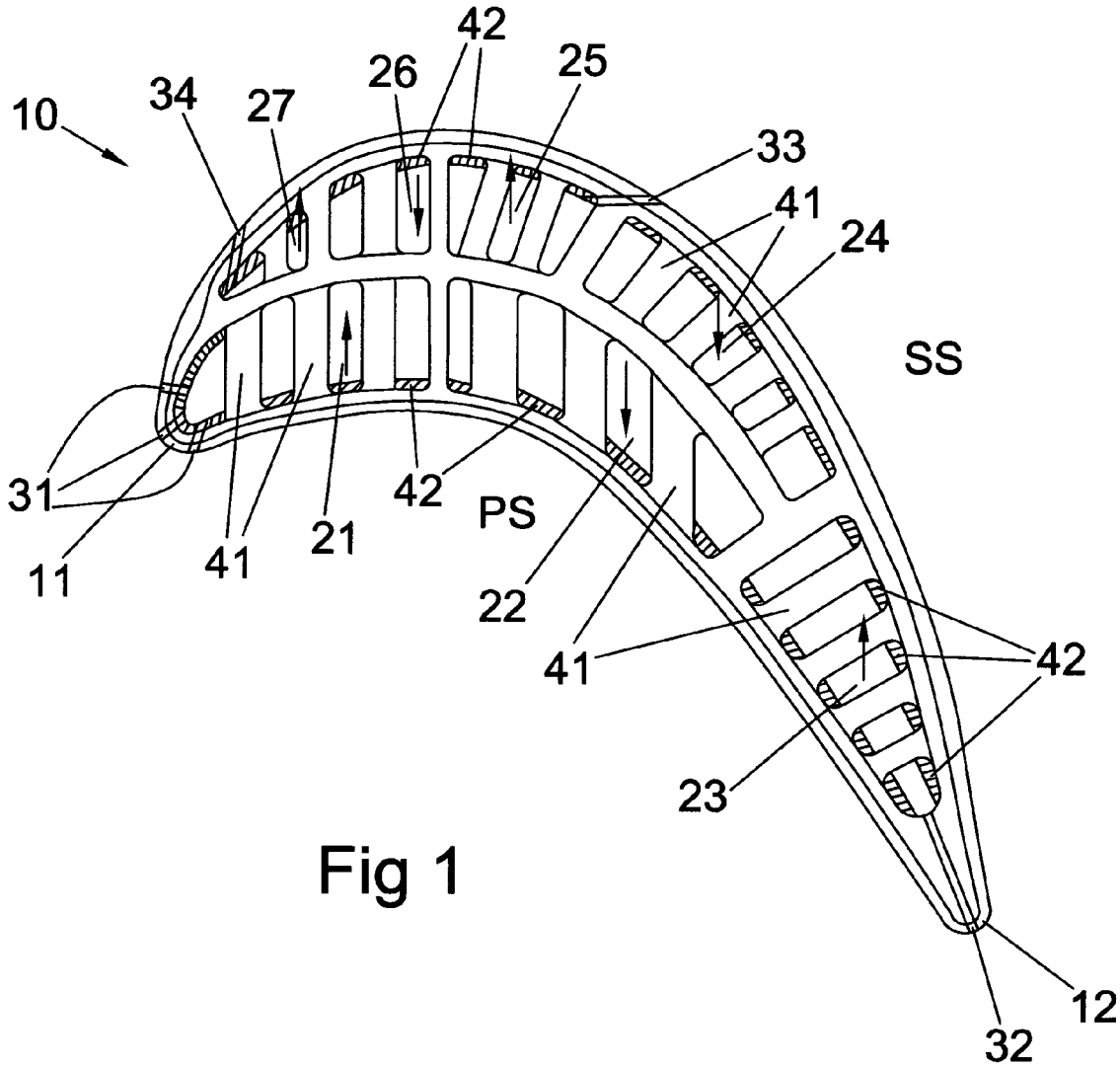
FIG. 1 shows a cross sectional view of the near wall serpentine flow cooling circuit of the present invention.

The present invention is a turbine blade having a seven pass serpentine flow cooling circuit with pins fins and trip strips positioned within the serpentine channels to promote heat transfer from blade walls to inner walls and to the cooling air passing through the channels. FIG. 1 shows the serpentine circuit of the present invention for a blade 10. The present invention could also be adapted for use in a turbine vane, both of which are considered to be turbine airfoils. The blade 10 includes a leading edge 11 and a trailing edge 12, and a pressure side (PS) and a suction side (SS) forming the airfoil shape. A first leg 21 of the serpentine circuit is located in the leading edge region of the blade. The first channel or leg 21 includes pin fins 41 extending from an inner partition wall to an outer wall of the blade. In the present embodiment, the first channel 21 includes 3 pin fins in the blade chordwise direction. Trip strips 42 are also located within the channel 21 on the outer side adjacent to the blade exterior surface. film cooling holes 31 forming a showerhead cooling circuit are located along the leading edge and connected to the first channel 21 to discharge a portion of the cooing air within the first channel 21 to the leading edge surface of the blade for cooling thereof.

Downstream from the first leg or channel 21 of the serpentine flow cooling circuit is the second leg or channel 22, and includes three pin fins 41 extending across the second channel 22 from the inner partition wall to the outer wall of the blade 10. Trip strips 42 are also located on the outer wall of the second channel 22 to promote heat transfer from the wall to the cooling air. A third channel 23 of the serpentine circuit is located along the trailing edge region of the blade, and includes pin fins 41 and trip strips 42 to enhance internal heat transfer performance and conducting heat from the airfoil wall to the inner partition wall. Cooling air exit holes 32 are spaced along the trailing edge of the blade 10 and discharge a portion of the cooling air flowing through the third channel 23.

Cooling air flowing through the third channel 23 in the trailing edge region then flows into the fourth leg 24, and then into the fifth leg 25, the sixth leg 26, and then the seventh leg 27 of the seven pass serpentine flow cooling circuit. Each of the legs or channels includes pin fins extending across the channel and trip strips along the hot wall section of the channels. The fifth leg channel 25 and the seventh leg channel 27 both include film cooling holes 33 and 34 to discharge cooling air to the blade surface. The locations of the film cooling holes are placed where the hottest external surface temperatures on the blade are found. Other embodiment of the present invention could include more film cooling holes in other channels if the external heat load requires the extra cooling.

The pin fins 41 extending across the channels provide conductive heat transfer from the outer blade wall to the inner wall partition to help in providing for a thermally balanced blade sectional temperature distribution. The pin fins 41 also reduce the flow area through the channels. Because of the film cooling holes located along the serpentine flow path, the volume of cooling air passing through the path will be reduced and therefore the flow velocity would normally fall if the channels were completely open. The pin fins therefore are sized and numbered within the channels to reduce the flow area and maintain a proper flow velocity through the serpentine path. The trip strips 42 located along the serpentine channels on the hot side of the channel act to promote turbulent flow within the cooling air to also enhance the heat transfer to the cooling air.

The cooling flow operation of the present invention is described below. Fresh cooling air is supplied through the airfoil leading edge cavity in the first leg or channel 21 of the serpentine flow circuit and provides cooling for the leading edge region where the external heat load is the highest. In addition, the pin fins 41 and trip strips 42 incorporated within the cooling supply cavity 21 enhance the internal heat transfer performance and conducts heat from the airfoil wall to the inner partition wall. Cooling air is then serpentine rearward through the forward section of the airfoil pressure side surface through channel 22. A parallel flow cooling flow technique is used for the airfoil pressure surface, where the cooling air flows inline with the airfoil external pressure and heat load. This design will maximize the use of cooling air pressure to maintain gas side pressure potential as well as tailoring the airfoil external heat load. A cooling scheme of this sort is particularly applicable to the airfoil pressure side just aft of the leading edge where the airfoil heat load is low. This eliminates the use of film cooling and generating a low heat sink at the forward portion of the pressure sidewall which balances the high heat load on the airfoil suction sidewall, especially with a hotter cooling air in the serpentine cooling cavities. The spent cooling air is then discharged into the blade root section open cavity where the cooling air is then transported into the trailing edge up pass flow channel 23.

The cooling air is channeled through the trailing edge pin bank radial channel 23 to provide cooling for the airfoil trailing edge section and portion of the cooling air exit out the airfoil trailing edge through multiple small holes 32 for the cooling of the airfoil trailing edge corner. This cooling flow channel 23 also serves as the first up-pass channel of the airfoil suction side forward flow serpentine circuit. The pin bank flow channels balanced the thermal distribution for both of the trailing edge pressure and suction side walls.

A counter flow cooling technique is utilized for the airfoil suction surface to maximize the use of cooling air. Cooler cooling air is supplied at down stream of the airfoil suction surface where the airfoil heat load is high. The cooling air flows toward the airfoil leading edge, picking up heat along the pin fins channel and then discharging into the airfoil external surface to provide a layer of precisely placed film cooling sub-layer at the location where the heat load is high and the main stream static pressure is still low. This counter flow cooling mechanism maximizes the use of cooling air and provides a very high overall cooling efficiency for the airfoil suction side surface. The pin fins used in the suction side serpentine flow channel conducting heat from the airfoil wall into the inner partition wall. Both the pressure side and the suction side pin fins are connected to the inner partition wall. This conducts heat to each other while the cooler cooling air cavity on the pressure side corresponds to the warmer air cavity on the suction side and therefore balancing the wall temperature for the airfoil pressure and suction side walls and achieving a thermally balanced blade cooling design.

In addition to the thermally balanced cooling design, the cooling circuit of the present invention is designed to also maximize the use of the hot gas side pressure distribution. The cooling flow initiates at the airfoil leading edge and ends at the airfoil suction side just downstream from the leading edge, which lowers the required cooling supply pressure and therefore reduces the overall blade leakage flow.

Figure 2:
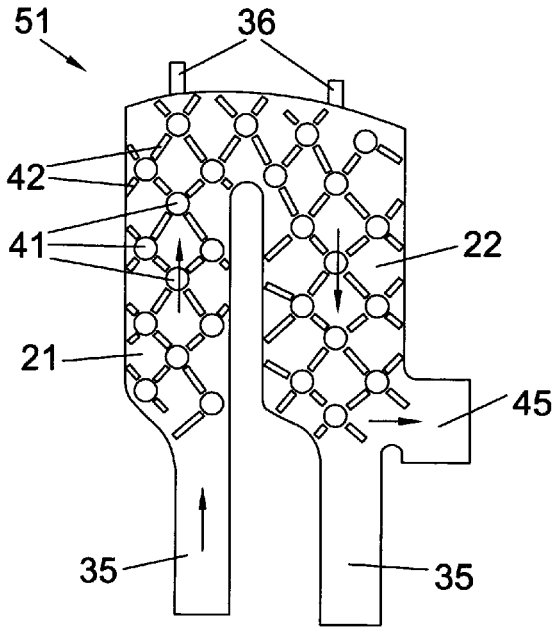
FIG. 2 shows a side view of a pressure side ceramic core used to form the cooling passages within the blade of FIG. 1.
Figure 3:
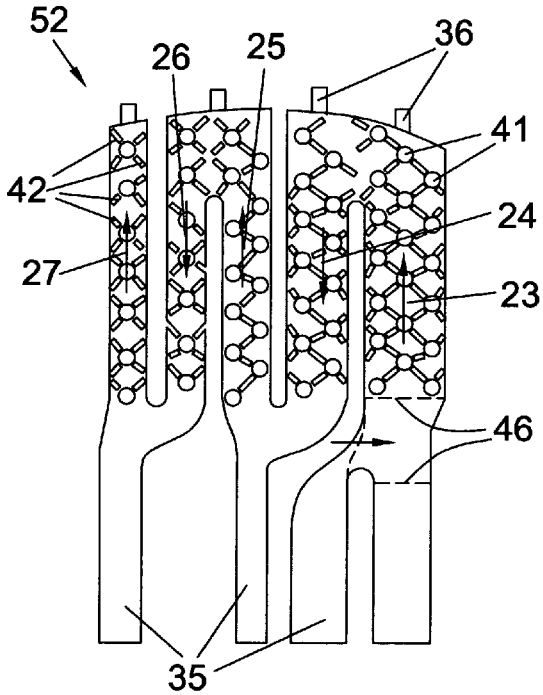
FIG. 3 shows a side view of a suction side ceramic core used to form the cooling passages within the blade of FIG. 1.
Figure 4:
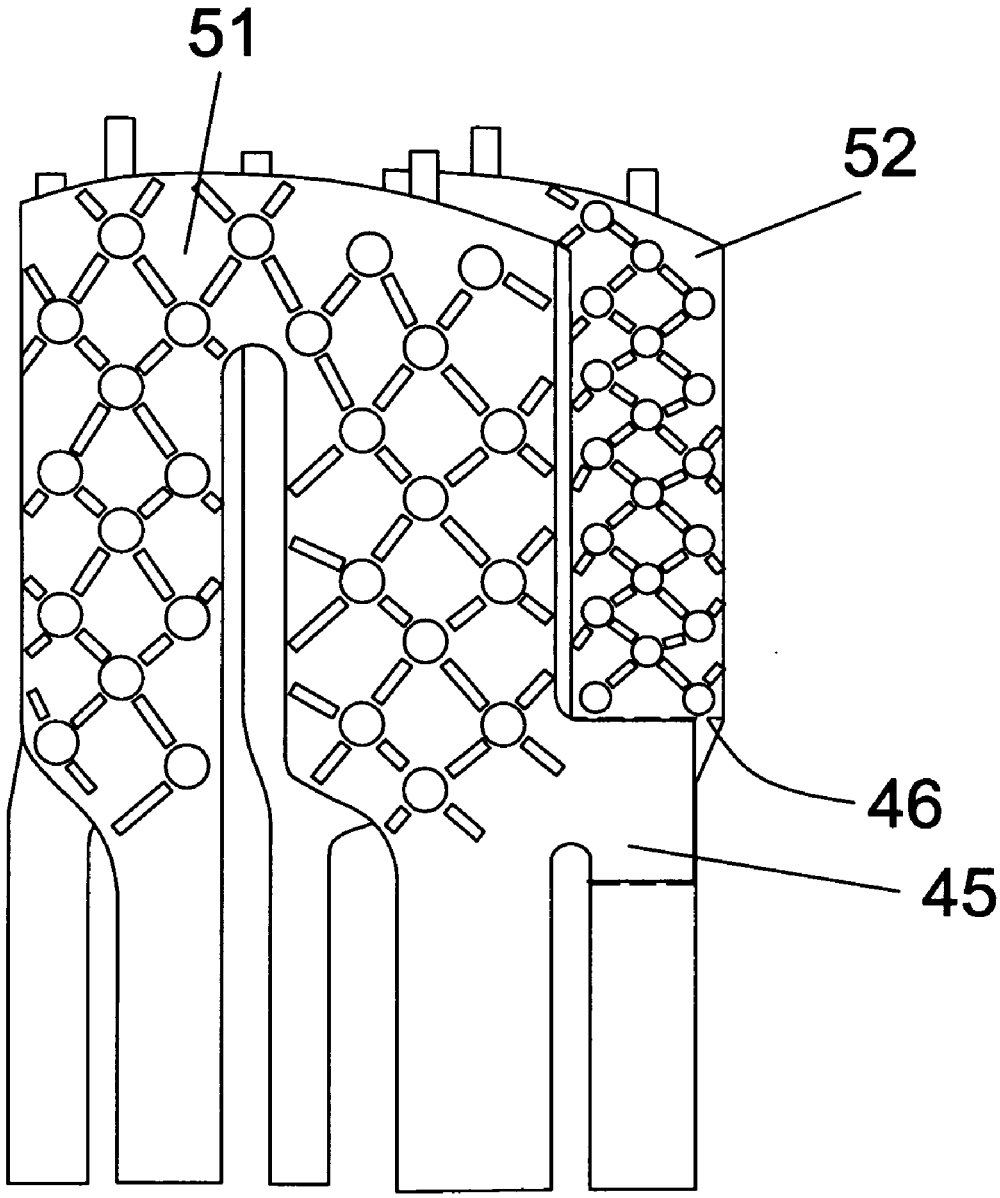
FIG. 4 shows a front view of the ceramic core assembly of the present invention.

A composite core manufacturing technique is used for the construction of the near wall serpentine flow cooling circuit of the present invention. The pressure side serpentine flow circuit is formed from a core die 51 with a cooling air transport tongue 45 at the root of the first down pass (the second leg) below the blade platform. The suction side serpentine flow circuit is formed from a separate core die 52 with a cooling air transport groove 46 at the root of the trailing edge up pass flow channel 23 (the third leg) below the blade platform. The cores 51 and 52 both include print outs 36 and core supports 35 to position and secure the cores within a die. The cores also have pin fins 41 with trip strips 42 spaced according to the design requirements of the cooling channels. Ceramic cores for the airfoil pressure side 51 and suction side 52 flow circuits are shown in FIGS. 2 and 3. Both ceramic cores 51 and 52 are pre-assembled together prior to insertion into a wax die. Precision mating for the root section groove and tongue location is formed with the use of ceramic slurry masking at the groove and tongue junction. Platinum pins are also used for positioning the spacing in-between the pressure side and the suction side ceramic core. Bumper technique may be used for the external airfoil wall formation. FIG. 4 shows the assembled ceramic core for the near wall serpentine flow circuit within the blade. When the tongue 45 of the pressure side core 51 is positioned within the groove 46 of the suction side core 52, a cooling air flow path is formed from the second channel 22 exit into the third channel 23 entrance. Thus, cooling air will flow from the second channel 22 into the third channel 23 in the serpentine flow circuit of the blade.

The near wall serpentine flow cooling circuit of the present invention is shown as a seven pass serpentine circuit with two passes on the pressure side and four passes on the suction side with a common trailing edge pass. However, other serpentine flow designs could be used such as a five pass serpentine circuit with two passes on the pressure side and two passes on the suction side with a common trailing edge pass in-between. Or, a six pass serpentine flow circuit could be used with two passes on the pressure side and three passes on the suction side with a common trailing edge pass in-between.

The cross sectional size of the pin fins can be varied throughout the serpentine flow circuit in order to vary the conductive heat transfer from wall to wall and to vary the flow area through the channels in order to regulate the heat transfer to the cooling air.

I claim:

1. A turbine airfoil for use in a gas turbine engine, the turbine airfoil including a leading edge and a trailing edge and a pressure side and a suction side, the turbine airfoil comprising:

a serpentine flow cooling circuit extending from the leading edge and along the pressure side to the trailing edge, and then extending from the trailing edge along the suction side to a location just downstream from the leading edge, the serpentine flow cooling circuit forming one continuous flow path for cooling air.

2. The turbine airfoil of claim 1, and further comprising:

each leg of the serpentine cooling flow circuit includes a plurality of pin fins and a plurality of trip strips.

3. The turbine airfoil of claim 1, and further comprising:

the leading edge includes a plurality of film cooling holes in fluid communication with the first leg of the serpentine flow cooling circuit; and, the trailing edge includes a plurality of exit cooling holes in communication with the serpentine flow cooling circuit.

4. The turbine airfoil of claim 1, and further comprising:

the serpentine flow cooling circuit includes a trailing edge channel to provide near wall cooling for both the pressure side and the suction side of the airfoil at the trailing edge region.

5. The turbine airfoil of claim 4, and further comprising:

the trailing edge channel includes a plurality of trailing edge exit cooling holes to provide cooling for the trailing edge region.

6. The turbine airfoil of claim 1, and further comprising:

at least one of the channels of the serpentine flow cooling circuit on the suction side includes a plurality of film cooling holes.

7. The turbine airfoil of claim 1, and further comprising:

the serpentine flow cooling circuit comprising a 2-pass serpentine flow path on the pressure side, a trailing edge channel, and a 4-pass serpentine flow path on the suction side, where the trailing edge channel provides near wall cooling for both the pressure side and the suction side of the trailing edge region.

8. The turbine airfoil of claim 7, and further comprising:

the first pass of the serpentine flow circuit on the pressure side includes a plurality of film cooling holes to provide film cooling for the leading edge; and, the second pass and the fourth pass channels of the serpentine flow circuit on the suction side includes a plurality of film cooling holes to provide film cooling to the suction side surface of the airfoil.

9. The turbine airfoil of claim 1, and further comprising:

the channels in the serpentine flow cooling circuit include a plurality of pin fins and trip strips.

10. The turbine airfoil of claim 1, and further comprising:

the serpentine flow cooling circuit forms a continuous flow path from the first pass on the pressure side to the last pass on the suction side.

* * * * *